US005676517A

United States Patent [19]

Lotz

[11] Patent Number: 5,676,517

[45] Date of Patent: Oct. 14, 1997

[54] METHOD AND APPARATUS FOR STACKING THIN SHEETS CARRYING PRODUCT

[76] Inventor: Walter E. Lotz, 6511 High Ridge Rd., Lantana, Fla. 33462

[21] Appl. No.: 507,217

[22] Filed: Jul. 26, 1995

[51] Int. Cl.[6] ..... B65G 57/06

[52] U.S. Cl. ..... 414/793.4; 414/786; 414/794; 414/794.2; 414/790.7

[58] Field of Search ..... 414/790.7, 793.9, 414/794.2, 786, 794

[56] References Cited

U.S. PATENT DOCUMENTS

| | | | |
|---|---|---|---|
| 3,186,565 | 6/1965 | Williamson | 414/793.9 X |
| 3,204,676 | 9/1965 | Gillman . | |
| 3,312,357 | 4/1967 | Stephens et al. . | |
| 3,392,853 | 7/1968 | Mitchell et al. . | |
| 3,415,389 | 12/1968 | Smith . | |
| 4,002,560 | 1/1977 | Grantham | 414/794 X |
| 4,026,421 | 5/1977 | Lotz . | |
| 4,280,618 | 7/1981 | Jensen | 414/794.2 X |
| 4,341,334 | 7/1982 | Bier | 225/96.5 |
| 4,532,751 | 8/1985 | Mally et al. | 53/396 |
| 4,543,864 | 10/1985 | Hochanadel et al. | 83/91 |
| 4,938,657 | 7/1990 | Benson et al. | 414/790.4 |
| 5,193,423 | 3/1993 | Bakker | 83/24 |

*Primary Examiner*—Janice L. Krizek
*Attorney, Agent, or Firm*—Lane, Aitken & McCann

[57] ABSTRACT

Thin sheets on which a product is held by limited adhesion are transferred from a first conveyor onto a speedup conveyor which slides the sheets, one by one, onto a pair of intermittently rotatable paddles. The paddles comprise a lattice of low-friction material and define receiving surfaces angled toward one another along a direction in which the sheets slide. The paddles rotate ½ revolution in response to the leading sheet on the speedup conveyor passing a photocell and form a stack in a compartment on an intermittently moving conveyor below. When a predetermined count of sheets is in the stack, the intermittently moving conveyor is advanced to move an empty compartment under the paddles.

19 Claims, 8 Drawing Sheets

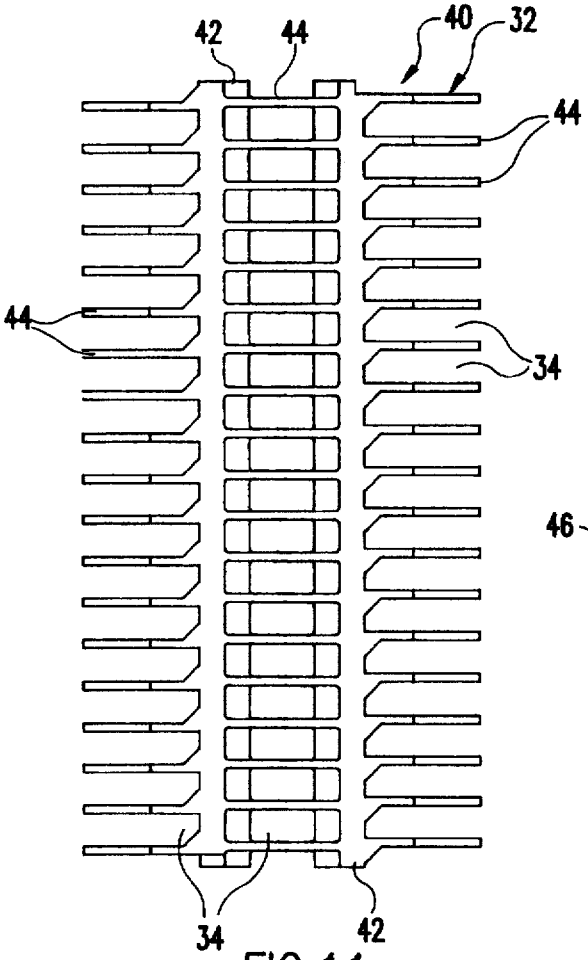
FIG.11
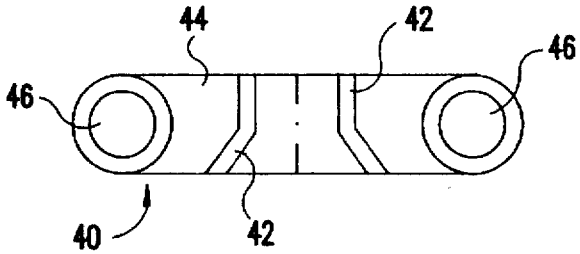
FIG.10
FIG.12
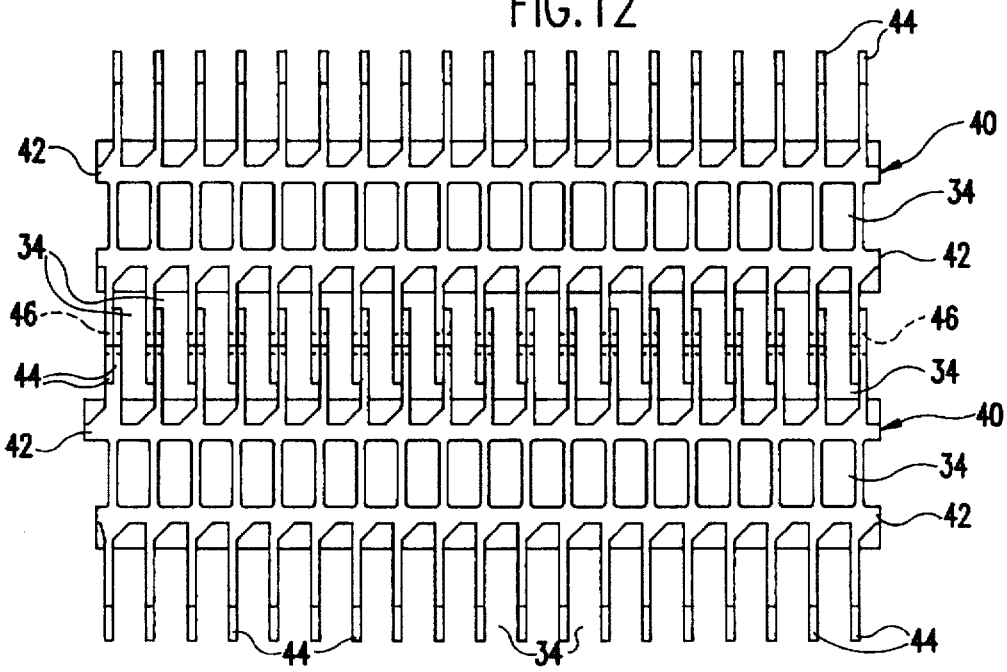

METHOD AND APPARATUS FOR STACKING THIN SHEETS CARRYING PRODUCT

BACKGROUND OF THE INVENTION

The present invention relates to a method and apparatus for stacking sheets and, more particularly, to a method and apparatus for quickly stacking, one by one, a series of thin sheets carrying a product held to the sheets by limited adhesion.

Machinery exists for forming a stack from serially conveyed thin sheets carrying a product, especially a food product such as bacon, which is held in place on the sheets by limited adhesion. One example is disclosed in U.S. Pat. No. 4,532,751 to Mally et al. It is known to convey thin products onto movable surfaces which subsequently drop the products, one by one, to form a stack. An example of this is disclosed in U.S. Pat. No. 4,026,421 to Lotz.

In developing a process for stacking sheets carrying a limited-adhesion product, two important design criteria are that the process be a high-speed process and that the adhesion between the product and the sheet not be disturbed. There is a tendency for such a process to be slow. Furthermore, there is a tendency for the product to be shaken loose from the sheet of paper to which it had some adhesion. Consequently, when the sheet is dropped to form a stack, the product flies off the paper and a poor stack is formed. Another problem is that the sheets are thin and have very little resistance to deformation, especially under the weight of the product adhering to the sheets.

SUMMARY OF THE INVENTION

By the present invention, a series of thin sheets each carrying a product held in place by limited adhesion are stacked at high speed with the adhesion undisturbed.

Thin sheets carrying bacon are transferred from a conveyor moving the sheets at a first speed onto a speedup conveyor which speeds up the sheets to move at a higher speed and slides the sheets onto a pair of rotatable paddles. The paddles are self-cleaning because the repeated sliding of sheets on the paddles wipes the paddles clean. The speedup conveyor has an upper surface which is slightly higher than an upper surface of the paddles to assure smooth movement of the sheets from the speedup conveyor to the paddles. Each paddle comprises a lattice of a low-friction material, such as polyethylene, to further assist smooth and complete movement of the sheets from the speedup conveyor to the paddles. Since the lattice has little surface area, no vacuum forms between the paddles and the sliding sheets which could slow the sliding of the sheets. The speed of the speedup conveyor is adjustable and is selected so that each sheet slides completely onto the paddles and stops without crumpling when it hits a stop at the distal end of the paddles. The paddles have a home position in which they are inclined slightly toward one another to form a pocket. The thin sliding sheets conform to the shape of the pocket and, in so doing, increase their resistance to deformation in a direction parallel to the direction in which the sheets slide, so that the sheets do not crumple when they engage the stop. In some cases, such as when the sheets are extremely thin or are wet, the inclining of the paddles does not add enough strength to prevent the sheets from crumpling when they hit the stop. In these cases, the speed of the speedup conveyor is adjusted so that the sheets slide completely onto the paddles and stop without engaging a stop. By adjusting the speed of the speedup conveyor, the sheets can be made to stop about ⅛ inch from a stop.

The paddles rotate in opposite directions to drop each sheet onto an intermittently moving conveyor to form a stack of the sheets carrying the bacon on the intermittent conveyor. A predetermined time after a sheet stops on the paddles, the paddles flip, or rotate one-half revolution, in response to the detection of the tail end of the leading sheet on the speedup conveyor passing a predetermined position. Compartments are defined on the intermittently moving conveyor such that each compartment receives one stack of sheets carrying bacon. When a stack of desired count or height has been formed in a first compartment, the intermittently moving conveyor is advanced so that an empty compartment is moved under the paddles.

BRIEF DESCRIPTION OF THE DRAWINGS

FIG. 10 is an end view of the module of FIG. 8;

FIG. 11 is a bottom plan view of the module of FIG. 8; and

FIG. 12 is a top plan view of two interlocking modules of FIG. 8.

DETAILED DESCRIPTION OF THE PREFERRED EMBODIMENT

Figure 1:
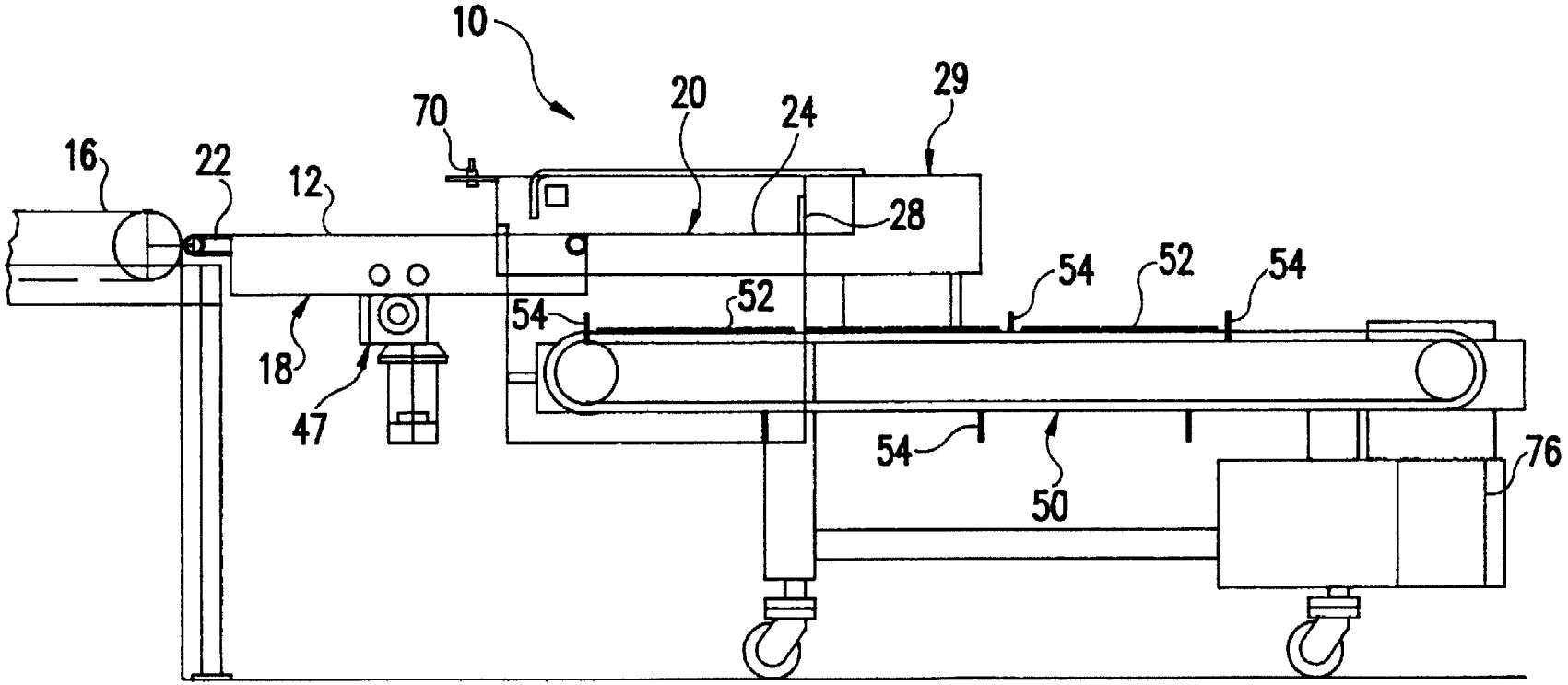
FIG. 1 is a side elevation of an apparatus according to the present invention for stacking thin sheets carrying a product.
Figure 2:
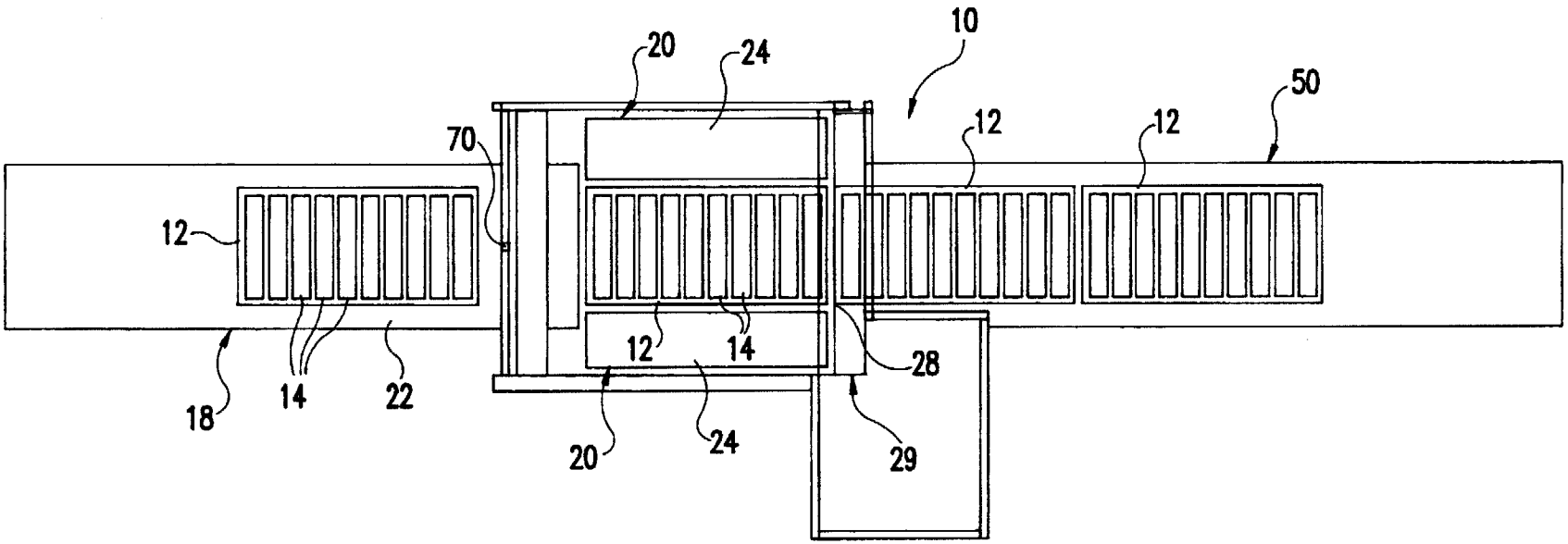
FIG. 2 is a top plan view of the apparatus of FIG. 1.
Figure 3:
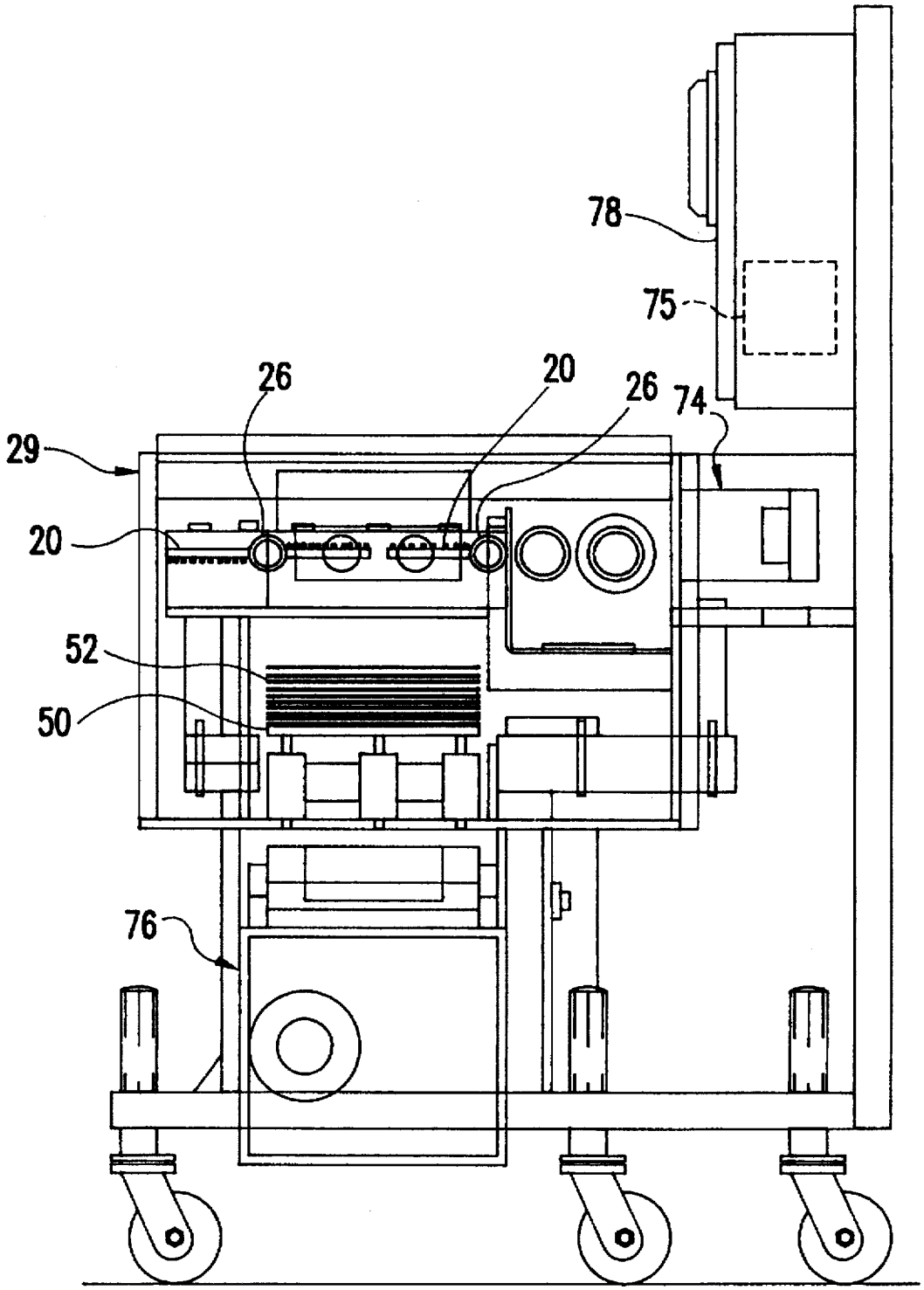
FIG. 3 is a left end view of the apparatus of FIG. 1.
Figure 4:
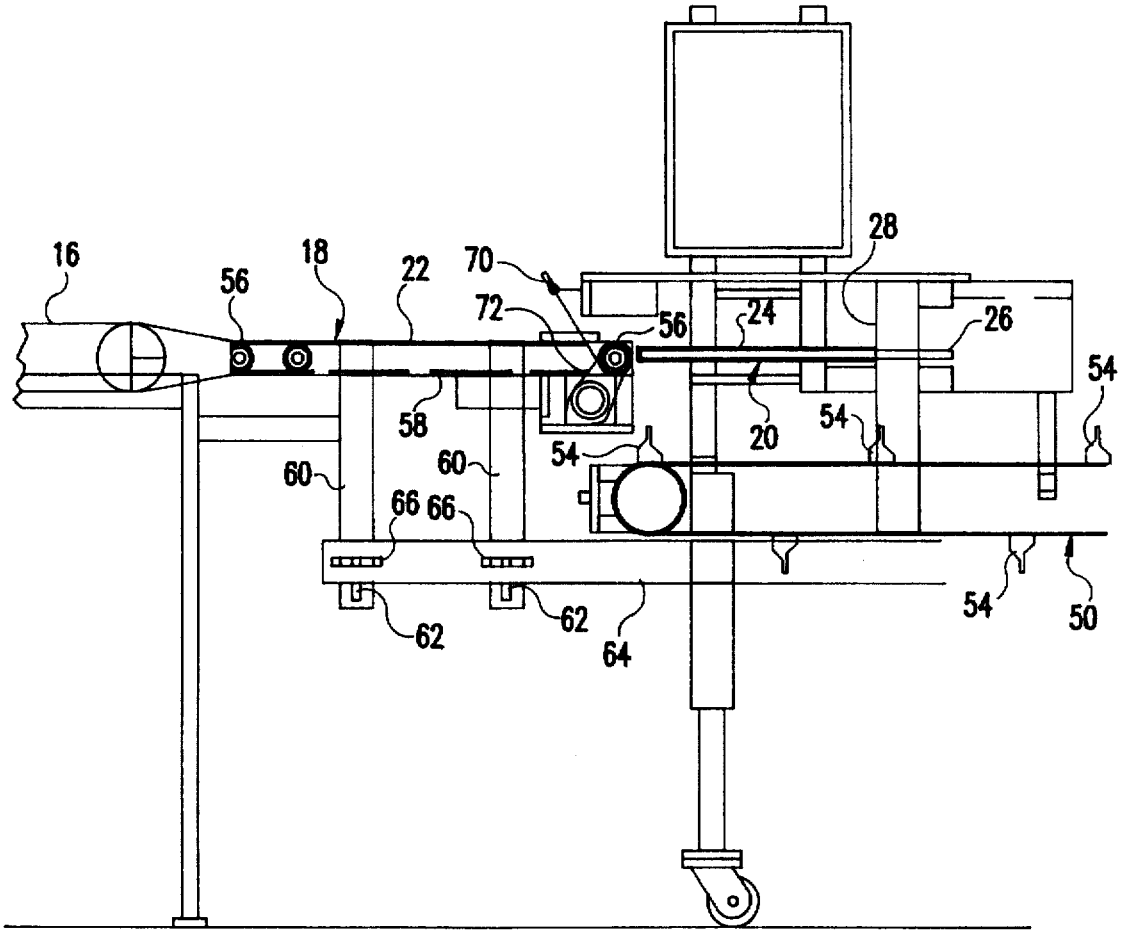
FIG. 4 is an enlarged side view of a portion of the apparatus of FIG. 1, showing a control panel.
Figure 5:
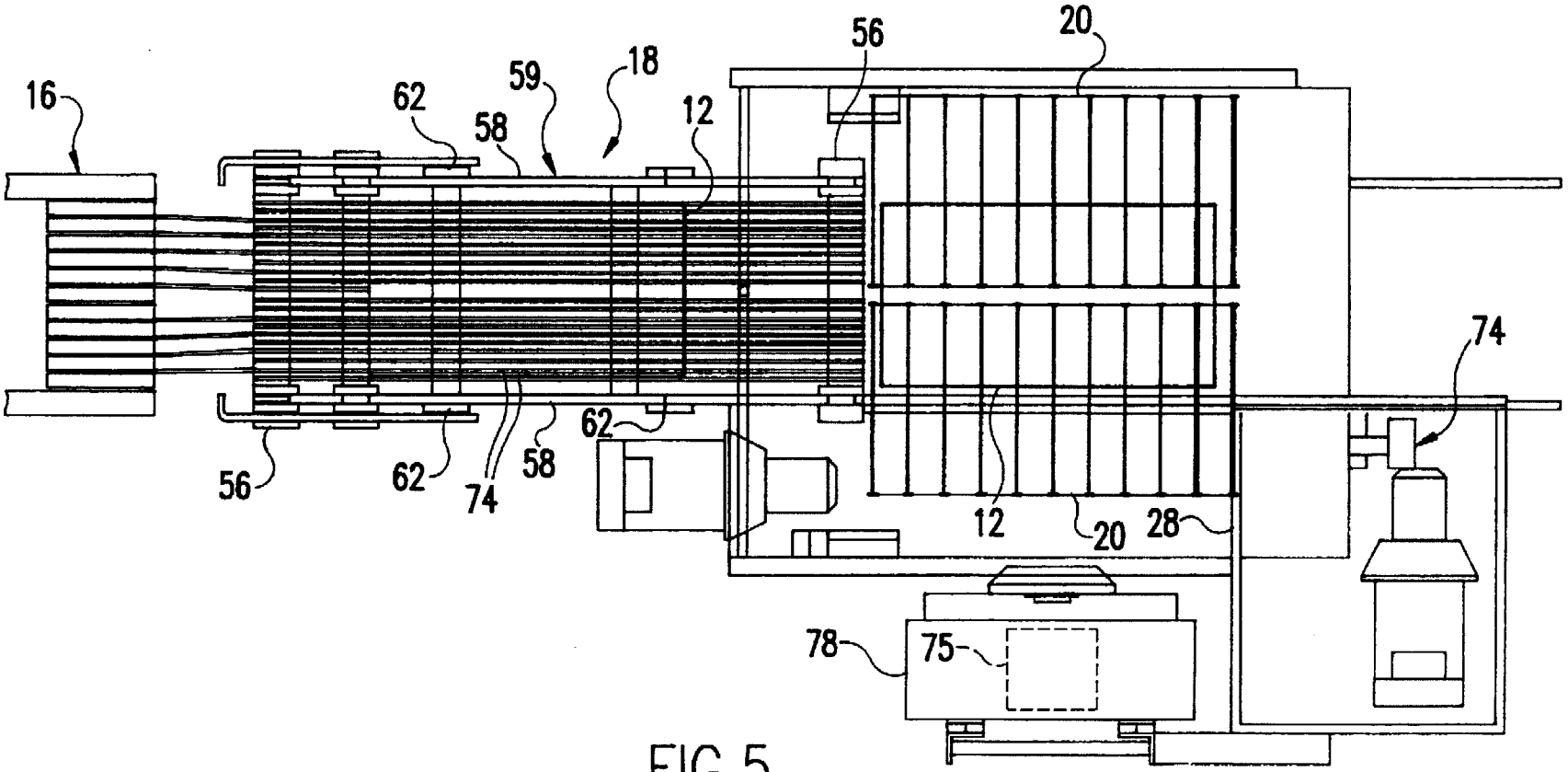
FIG. 5 is an enlarged bottom plan view of a portion of the apparatus of FIG. 1.
Figure 6:
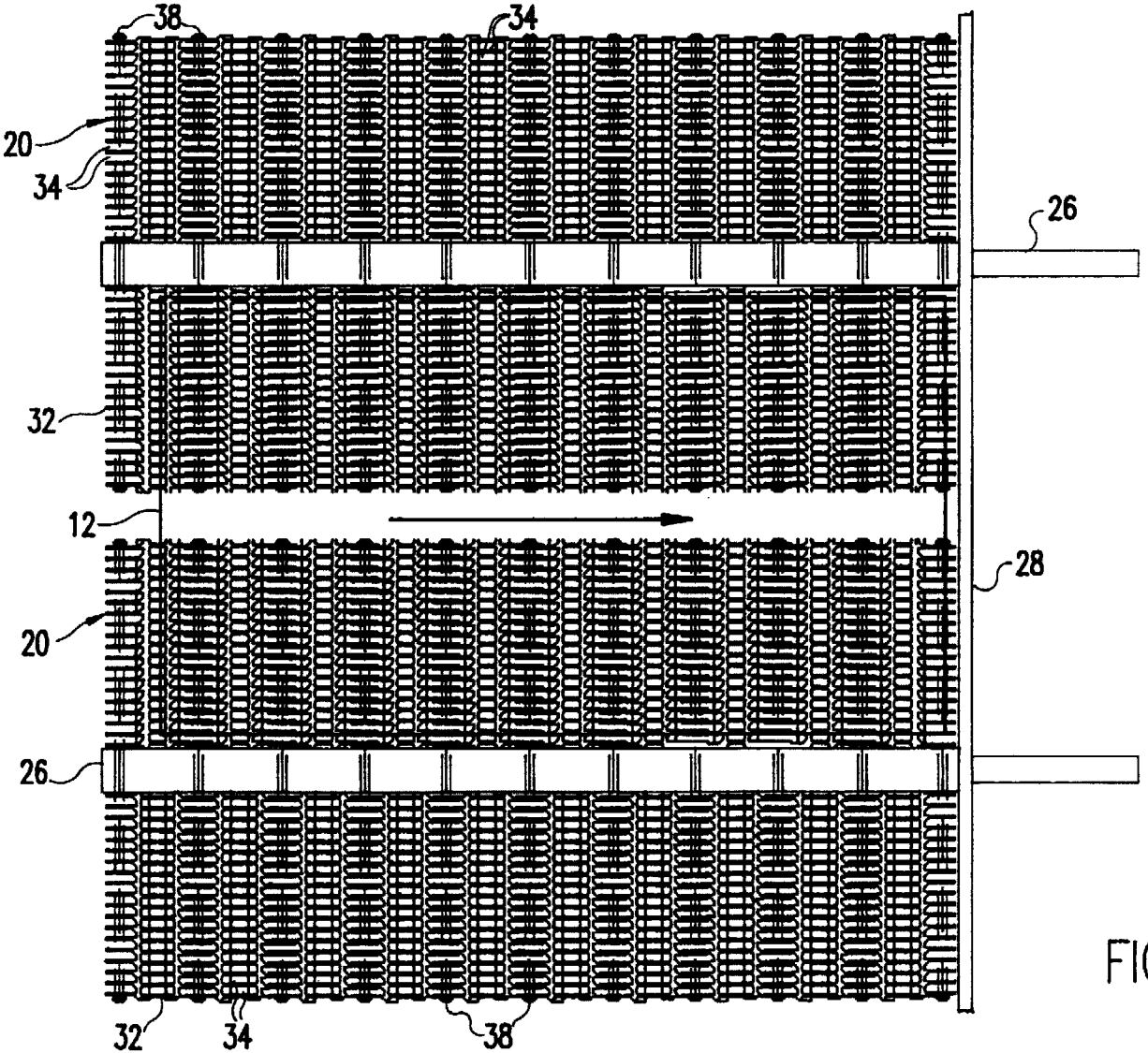
FIG. 6 is an enlarged top plan view of rotatable paddles in the apparatus of FIG. 1.
Figure 7:
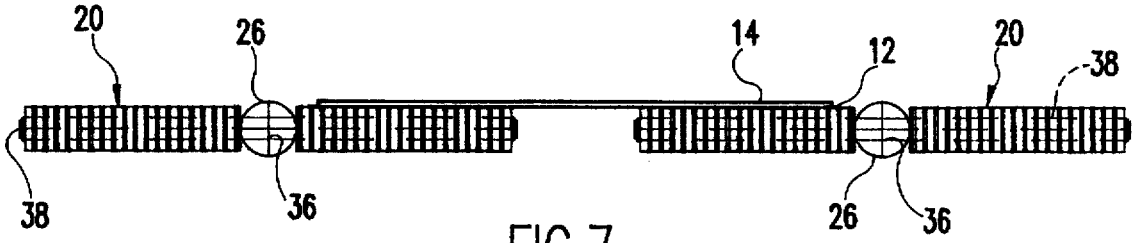
FIG. 7 is a left end view of the paddles of FIG. 6.
Figure 8:
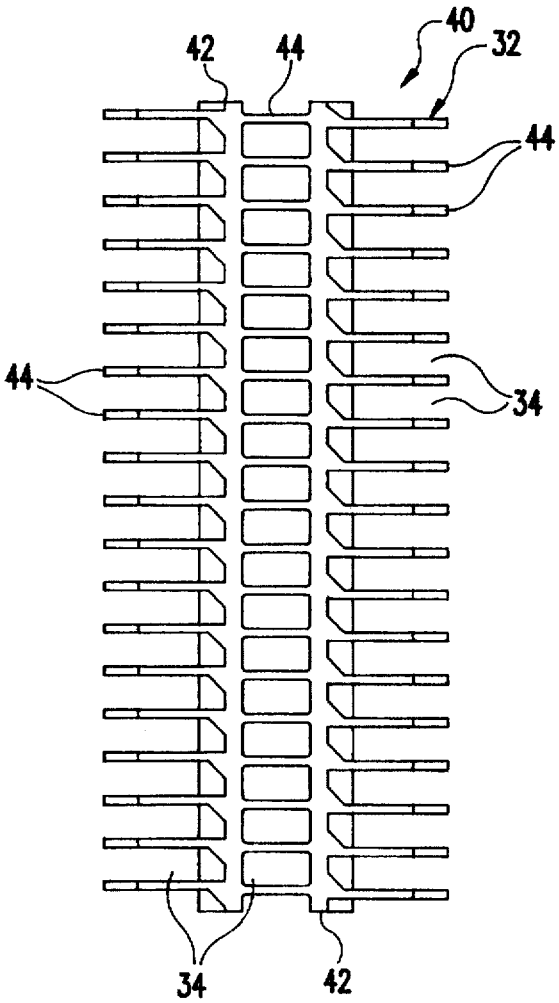
FIG. 8 is an enlarged top plan view of a module comprising a portion of one of the paddles of FIG. 6.
Figure 9:
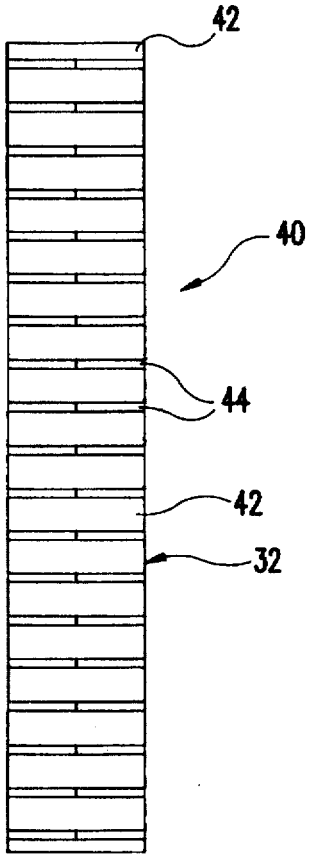
FIG. 9 is a front elevation of the module of FIG. 8.

As can be seen from FIGS. 1–3, the apparatus according to the present invention, which is designated generally by the reference numeral 10, receives thin sheets 12 of paper carrying strips 14 of bacon from a source, particularly, from a conveyor 16. For example, ten slices of bacon are deposited on sheets 10½ inches wide by 18¾ inches long, with about a one-half inch space between adjacent slices of bacon. Thus, the sheet 12 of paper is the connecting and transport medium between the strips 14 of bacon, and the strips are held with limited adhesion to the sheet due to the nature of the bacon. The product just described is given as an example, and it is contemplated that the present invention can be used with sheets to which other products are adhered and with products of sheet form.

The apparatus 10 includes a speedup conveyor 18 which receives the sheets 12 carrying the bacon from the conveyor 16, increases the speed of the sheets and slides the sheets, one after another, onto a pair of rotatable paddles 20. The speedup conveyor 18, which can be of the endless belt type, has an upper surface 22 which is slightly higher than an upper surface 24 of the paddles 20 to assure smooth movement of the sheets 12 from the speedup conveyor 18 to the paddles. The appropriate distance between the height of the upper surface 22 of the speedup conveyor 18 and the upper surface 24 of the paddles 20 can be determined by simple experimentation. For example, it has been found that arranging the upper surface 22 of the speedup conveyor 18 about ⅛" above the upper surface 24 of the paddles 20 is suitable for conveying sheets 12 carrying strips 14 of bacon where the horizontal distance between the adjacent ends of the speedup conveyor and the paddles is about ⅛".

As can be seen from FIGS. 4–7, the paddles 20 are mounted on shafts 26 which are parallel to the direction of sliding of the sheets 12 and parallel to and spaced from one another. The shafts 26 project from a wall 28 which defines part of a cabinet 29, the wall 28 being positioned at the ends of the paddles 20 distal to the speedup conveyor 18. The wall 28 is the stop for the sliding sheets 12. As can best be appreciated from FIGS. 6 and 7, each paddle 20 comprises a lattice 32 defining through openings 34 which occupy an area greater than the area occupied by the material of the lattice. Due to the large area of through openings 34, sheet-slowing vacuums are not created between the sliding sheets 12 and the paddles 20. Each shaft 26 has a plurality of transverse through bores 36, and a pin 38 extends through each through bore and has projecting portions projecting from the shaft 26, on opposite sides of the shaft.

As can be seen from FIGS. 8–12, each paddle 20 comprises a plurality of lattice modules 40. Each module 40 comprises a lattice 32 of a material having a low coefficient of friction, such as polyethylene, Delrin, or Teflon, and most of the area within the outline of the sheet-engaging surfaces of the module 40 is defined by the through openings 34. The lattice 32 includes longitudinal portions 42 and a plurality of transverse portions 44, aligned bores 46 being present at the ends of the transverse portions to receive the pins 38. The lattice modules 40 are retained on the pins 38 by a conventional arrangement, such as annular grooves in the ends of the pins 38 and snap retaining rings in the grooves. As can be seen from FIG. 12, the transverse portions 44 of the lattice modules overlap and interlock with the transverse portions 44 of the adjacent lattice modules, the bores 46 of the overlapped transverse portions being in alignment with one another.

The speed of the speedup conveyor 18 is adjustable, such as by use of a variable speed drive 47 (FIG. 1), and is selected so that each sheet 12 slides completely onto the paddles 20 but is not crumpled when it hits the stop 28. Crumpling is possible despite the inclining of the paddles 20, if the speedup conveyor 18 shoots the sheets 12 onto the paddles with too much force, especially if a relatively heavy product is on the sheets. Furthermore, in some cases, such as when the sheets 12 are extremely thin or are wet, the inclining of the paddles 20 does not add enough strength to prevent the sheets from crumpling when they hit the stop 28. In these cases, the speed of the speedup conveyor 18 is adjusted so that the sheets 12 slide completely onto the paddles 20 and stop without engaging a stop. By adjusting the speed of the speedup conveyor 18, the sheets 12 can be made to stop about ⅛ inch from a stop.

The shafts 26 are spaced such that a half of each paddle 20 can extend from the center line of its shaft 26 toward the opposite shaft and be in close proximity to the similarly extending half of the other paddle 20. Together, the two half paddles define a movable surface which receives a sheet 12 from the speedup conveyor 18. From the position shown in FIGS. 6 and 7, the paddle halves extending toward one another move downward and away from one another, thereby causing the sheet 12 to drop. The paddles 20 flip, or rotate 180 degrees, so that the paddle halves previously projecting away from the opposite paddle 20 are brought into registry with one another to form a movable receiving surface for the next sheet 12. The paddles 20 are inclined slightly toward one another, each on the order of 1.5 degrees from horizontal, along a line parallel to the direction of sliding of the sheets 12, to form a pocket at the receiving surface. The thin sheets 12 conform to the shape of the pocket and, in so doing, increase their resistance to deformation or crumpling in a direction parallel to the direction in which the sheets slide.

As can be seen from FIGS. 1 and 3, the paddles 20 drop each sheet 12 onto an intermittently moving conveyor 50 to form a stack 52 of the sheets carrying the bacon. The paddles 20 flip or rotate in response to the detection of the tail end of this sheet, which is the leading sheet on the speedup conveyor 18, passing a predetermined position. In response to the detection of each subsequent sheet, the paddles 20 flip, or rotate, again, in the same direction as with the previous sheets. Compartments are defined on the intermittently moving conveyor by spaced cleats 54 such that each compartment receives one stack 52 of sheets 12 carrying bacon. When a stack 52 of desired count or height has been formed in a first compartment, the intermittently moving conveyor 18 is advanced so that an empty compartment is moved under the paddles 20 to receive the next stack.

The paddles 20 temporarily hold and then drop the sheets 12, one by one, into the compartment below. The level of the upper surface 22 of the speedup conveyor is adjustable relative to the upper surface of the paddles 20 in the home position, which is the sheet-receiving position. As can be seen from FIGS. 4 and 5, the speedup conveyor 18 includes end rollers 56 mounted for rotation on rails 58 which are a part of a frame 59. The frame 59 is mounted on uprights 60 which define vertical slots 62 at their lower ends. The uprights 60 are connected to horizontal supports 64 defining horizontal slots 66, with the horizontal slots 66 overlapping the vertical slots 62, and releasable fasteners, such as bolts, extending through the overlapped portions of the slots 62 and 66 and tightened to fix the uprights 60 relative to the horizontal supports 64. By releasing the fasteners and adjusting the overlap of the vertical and horizontal slots 62, 66, the horizontal and vertical position of the uprights 60 and, thus, of the speedup conveyor 18, can be adjusted.

The tail end of the leading sheet 12 on the speedup conveyor 18 is detected by a photocell 70 which directs an infrared beam through the path of the sheets on the conveyor and onto a reflector 72 mounted on an opposite side of the path. As can be seen from FIG. 5, the speedup conveyor 18 comprises a plurality of narrow endless belts 74, for example, eighteen, spaced about ½" apart. Thus, the photocell 70 is mounted above the upper run of the speedup conveyor 18 and directed through a space between belts 74 to the reflector 72 mounted below the upper run. Each sheet 12 interrupts the infrared beam, preventing the beam from reaching the reflector 72 and returning. After the tail end of each sheet 12 passes through the beam, the beam strikes the reflector 72 and returns, thereby completing a control circuit and actuating the paddles 20, just after the sheet which just passed the beam has stopped on the paddles.

A variable time delay is built into the circuit so that the paddles 20 are flipped or rotated an adjustable predetermined time, for example, 0–150 msec., after the tail end of the sheet 12 passes through the infrared beam. The time delay is selected to allow just enough time for a sheet 12 to slide completely onto the paddles 20 and hit the stop 28. The speed of the speedup conveyor 18 is chosen so that each sheet 12 slides completely onto the paddles 20 and hits the stop 28 without crumpling the sheet. For sheets with insufficient strength to avoid crumpling, the speed of the speedup conveyor 18 is chosen so that each sheet 12 slides completely onto the paddles 20 and stops without touching the stop 28. When the product on the thin sheets is relatively heavy, the speedup conveyor 18 must be operated at a somewhat slower speed than with a lighter product, so that the heavy product does not crumple the sheets against the stop 28. With the speedup conveyor 18 moving more slowly the sheets 12 slide more slowly on the paddles 20 to the stop 28. Accordingly, a relatively longer time delay for actuating the paddles 20 might be appropriate. With lighter product, the speedup conveyor 18 can be operated faster, and the paddles 20 actuated after a shorter, or even no, time delay. It has been found with a very light product that a product-carrying sheet 12 released by a flip or 180° rotation of the paddles 20 is struck from above by the underside of the paddles at the end of their flip or rotation. As a result, the fall of the sheet 12 from the paddles 20 onto the stack 52 is assisted by the paddles and further sped up.

Signals sent from the photocell 70 to a drive 74 for actuating the paddles 20 can also be directed to a control computer 75 for a drive 76 for the intermittently moving conveyor 50. A number corresponding to the desired number of sheets 12 in a stack 52 is entered into the memory of the computer 75. A signal or pulse from the photocell 70 representative of the movement of each sheet 12 on the speedup conveyor 18 which passes the photocell is directed to the counter. When the number of pulses counted by the counter equals the desired number of sheets 12 in a stack 52, which is preset in the computer memory, the computer 75 actuates the drive 76 to move the intermittently moving conveyor 50 so that an empty compartment moves under the paddles 20 and stops. The computer 75 may be mounted in a control box 78.

It will be apparent to those skilled in the art and it is contemplated that variations and/or changes in the embodiments illustrated and described herein may be made without departure from the present invention. For example, although the invention has been described in connection with sheets carrying bacon, the invention can be used with sheets carrying other products under adhesion, or with other stackable sheet-like articles. Accordingly, it is intended that the foregoing description is illustrative only, not limiting, and that the true spirit and scope of the present invention will be determined by the appended claims.

I claim:

1. Apparatus for stacking thin sheets carrying a product held to the sheets by limited adhesion comprising:

means for temporarily holding and then dropping the sheets one by one, said holding and dropping means comprising a movable surface;

means for sliding said sheets at a speed onto said movable surface;

means for adjusting the speed at which said sliding means slides said sheets onto said movable surface; and means for moving the movable surface to drop each said sheet when the sheet stops on the movable surface, wherein said means for sliding said sheets comprises a conveyor having an upper surface which is slightly higher than said movable surface, and the apparatus further comprises means for varying the height of said upper surface of said conveyor relative to said movable surface.

2. The apparatus of claim 1, wherein said means for sliding said sheets comprises a conveyor, and said means for adjusting the speed comprises means for varying the speed at which the conveyor moves said sheets.

3. The apparatus of claim 1, further comprising a conveyor positioned under said movable surface to receive the sheets.

4. The apparatus of claim 1, wherein said movable surface comprises intermittently rotatable surfaces.

5. The apparatus of claim 1, wherein the movable surface is defined by two paddles, each paddle being rotatable about an axis parallel to the direction of sliding of the sheets.

6. The apparatus of claim 5, wherein the paddles are made of a material having a coefficient of friction on the order of the coefficient of friction of polyethylene.

7. The apparatus of claim 1, wherein said means for sliding said sheets comprises a conveyor carrying said sheets, and said means for moving the movable surface comprises means for detecting movement of the tail end of a leading sheet on the conveyor past a predetermined point on the conveyor and means for actuating said means for moving in response to detection of movement of the tail end of the leading sheet past the predetermined point.

8. The apparatus of claim 7, wherein said means for detecting comprises a reflector and means for directing an infrared beam at the reflector through the path of the sheets on the conveyor.

9. The apparatus of claim 8, wherein the conveyor comprises a plurality of parallel endless loops and at least one space between endless loops, the infrared beam passing through the at least one space.

10. The apparatus of claim 7, wherein said means for actuating comprises means for moving the movable surface a variable time after the detection of movement of the tail end of the leading sheet past the predetermined point.

11. Apparatus for stacking thin sheets carrying a product held to the sheets by limited adhesion comprising:

means for temporarily holding and then dropping the sheets one by one, said holding and dropping means comprising a movable surface;

means for sliding said sheets at a speed onto said movable surface;

means for adjusting the speed at which said sliding means slides said sheets onto said movable surface; and means for moving the movable surface to drop each said sheet when the sheet stops on the movable surface, wherein the movable surface comprises two elements, the elements having receiving positions in which, to define a pocket, the elements are inclined toward one another along a line parallel to the direction in which the sheets slide.

12. The apparatus of claim 11, wherein said pocket defines means for increasing the resistance of the sheets to deformation in a direction parallel to the direction of sliding of the sheets.

13. Apparatus for stacking thin sheets carrying a product held to the sheets by limited adhesion comprising:

means for temporarily holding and then dropping the sheets one by one, said holding and dropping means comprising a movable surface;

means for sliding said sheets at a speed onto said movable surface;

means for adjusting the speed at which said sliding means slides said sheets onto said movable surface; and means for moving the movable surface to drop each said sheet when the sheet stops on the movable surface, wherein the movable surface is defined by two paddles, each paddle is rotatable about an axis parallel to the direction of sliding of the sheets, and each said paddle has a sheet support surface comprising a lattice of material.

14. The apparatus of claim 13, wherein said material has a coefficient of friction the order of the coefficient of friction of polyethylene.

15. The apparatus of claim 13, wherein said sheet support surface defines openings within said lattice, said openings occupying an area greater than the area of said sheet support surface occupied by the material of said lattice.

16. Apparatus for stacking thin sheets carrying a product held to the sheets by limited adhesion comprising:

means for temporarily holding and then dropping the sheets one by one, said holding and dropping means comprising a movable surface;

means for sliding said sheets at a speed onto said movable surface;

means for adjusting the speed at which said sliding means slides said sheets onto said movable surface; and means for moving the movable surface to drop each said sheet when the sheet stops on the movable surface, wherein the movable surface is defined by two paddles, each paddle is rotatable about an axis parallel to the direction of sliding of the sheets, and each said paddle comprises:

a shaft defining a plurality of transverse through bores;

a pin extending through each through bore and having projecting portions projecting from the shaft on opposite sides of the shaft; and a plurality of lattice modules each having through bores receiving two of said pins.

17. A method for stacking a series of thin sheets each carrying at least one product item held in place by limited adhesion comprising:

conveying the sheets serially onto intermittently rotatable surfaces such that the sheets slide completely onto the rotatable surfaces and stop;

rotating the rotatable surfaces about 180° to drop each sheet a predetermined time after the sheet stops on the rotatable surfaces, and before a subsequent sheet moves onto the rotatable surfaces; and forming a stack of the sheets below the rotatable surfaces.

18. The method of claim 17, further comprising increasing the resistance of the sheets to deformation in a direction parallel to the direction in which the sheets slide by receiving the sheets on rotatable surfaces having surface portions inclined toward one another along a line parallel to the direction in which the sheets slide.

19. The method of claim 17, further comprising rotating the rotatable surfaces in response to the reaching of a predetermined position by the tail end of the sheet in the series next following the sheet on the rotatable surfaces.

* * * * *